US008292668B2

(12) United States Patent
Lin

(10) Patent No.: US 8,292,668 B2
(45) Date of Patent: Oct. 23, 2012

(54) ELECTRICAL CONNECTOR

(75) Inventor: Chih-Ming Lin, Taichung (TW)

(73) Assignee: Excel Cell Eletronic Co., Ltd., Taichung (TW)

( * ) Notice: Subject to any disclaimer, the term of this patent is extended or adjusted under 35 U.S.C. 154(b) by 0 days.

(21) Appl. No.: 13/068,538

(22) Filed: May 12, 2011

(65) Prior Publication Data

US 2011/0294355 A1 Dec. 1, 2011

(30) Foreign Application Priority Data

May 28, 2010 (TW) ..... 99117188 A

(51) Int. Cl.
*H01R 24/00* (2011.01)

(52) U.S. Cl. ..... 439/636; 429/62

(58) Field of Classification Search ..... 439/59, 439/62, 630, 636, 637, 492, 495
See application file for complete search history.

(56) References Cited

U.S. PATENT DOCUMENTS

| | | | | |
|---|---|---|---|---|
| 7,452,242 | B2 * | 11/2008 | Poh et al. | 439/636 |
| 7,484,992 | B2 * | 2/2009 | Boischio | 439/404 |
| 7,497,714 | B2 * | 3/2009 | Wang | 439/328 |
| 7,654,870 | B2 * | 2/2010 | Lemke | 439/636 |
| 7,708,599 | B2 * | 5/2010 | Guan et al. | 439/636 |

* cited by examiner

*Primary Examiner* — Khiem Nguyen
(74) *Attorney, Agent, or Firm* — Kilpatrick Townsend & Stockton LLP

(57) ABSTRACT

In an electrical connector, a housing includes opposite front and rear end walls, and an insertion slot that is formed between opposite upper and lower inner wall surfaces extending in a front-rear direction and that opens at the front end wall. A terminal has a movable arm and a stationary arm that are disposed respectively on two sides of the insertion slot. The movable arm has a front barb-like contact portion proximate to the front end wall. The stationary arm is tapered forwardly, and has a front end distal from the front end wall, and an inclined contact face that is inclined rearwardly and gradually toward the insertion slot from its front end. The electrical connector has a miniaturized construction and reduces an insertion force for inserting a printed circuit board.

6 Claims, 8 Drawing Sheets

ELECTRICAL CONNECTOR

CROSS-REFERENCE TO RELATED APPLICATION

This application claims priority to Taiwanese Application No. 099117188, filed May 28, 2010, the disclosure of which is incorporated herein by reference.

BACKGROUND OF THE INVENTION

1. Field of the Invention

The invention relates to an electrical connector, and more particularly to a thin-type electrical connector adapted for connecting a printed circuit board.

2. Description of the Related Art

Referring to FIGS. 1 and 2, a conventional electrical connector 2 adapted for connecting to a flexible printed circuit board (FPC) 1 is shown to include a housing 21 and a conductive terminal 22 mounted inside the housing 21. The housing 21 is formed with an insertion slot 211. The terminal 22 includes a pair of opposite movable arms 221 inserted into the insertion slot 211. When the flexible printed circuit board 1 is inserted into the insertion slot 211, the movable arms 221 are pushed outwardly and oppositely by the flexible printed circuit board 1, and the flexible printed circuit board 1 is clamped by and placed in electrical contact with the movable arms 221.

However, because the movable arms 221 are pushed transversely in opposite outward directions during insertion of the flexible printed circuit board 1, the insertion slot 211 of the housing 21 must be large enough to permit movements of the movable arms 221. Thus, the electrical connector 2 is provided with a minimum height of 2 mm-3 mm, which cannot be reduced further. In addition, because both of the movable arms 211 apply a clamping force to the flexible printed circuit board 1, a relatively large force is required to insert the flexible printed circuit board 1 between the movable arms 211.

SUMMARY OF THE INVENTION

An object of the present invention is to provide an electrical connector that has a reduced height compared to the prior art.

Another object of the present invention is to provide an electrical connector into which a printed circuit board can be inserted with a relatively low insertion force.

Accordingly, an electrical connector of this invention comprises a housing which includes opposite front and rear end walls, opposite upper and lower inner wall surfaces extending in a front-rear direction, and an insertion slot that is formed between said upper and lower inner wall surfaces and that opens at said front end wall surface. The electrical connector further comprises at least one terminal disposed in the housing and having a movable arm and a stationary arm both of which extend in a direction from the rear end wall to the front end wall. The movable arm is disposed on one of upper and lower sides of the insertion slot, and has a front barb-like contact portion proximate to the front end wall. The stationary arm is disposed on the other one of the upper and lower sides of the insertion slot, and is tapered forwardly. The stationary arm has a front end distal from the front end wall and an inclined contact face that extends rearwardly from the front end and that is inclined gradually toward the insertion slot from the front end.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
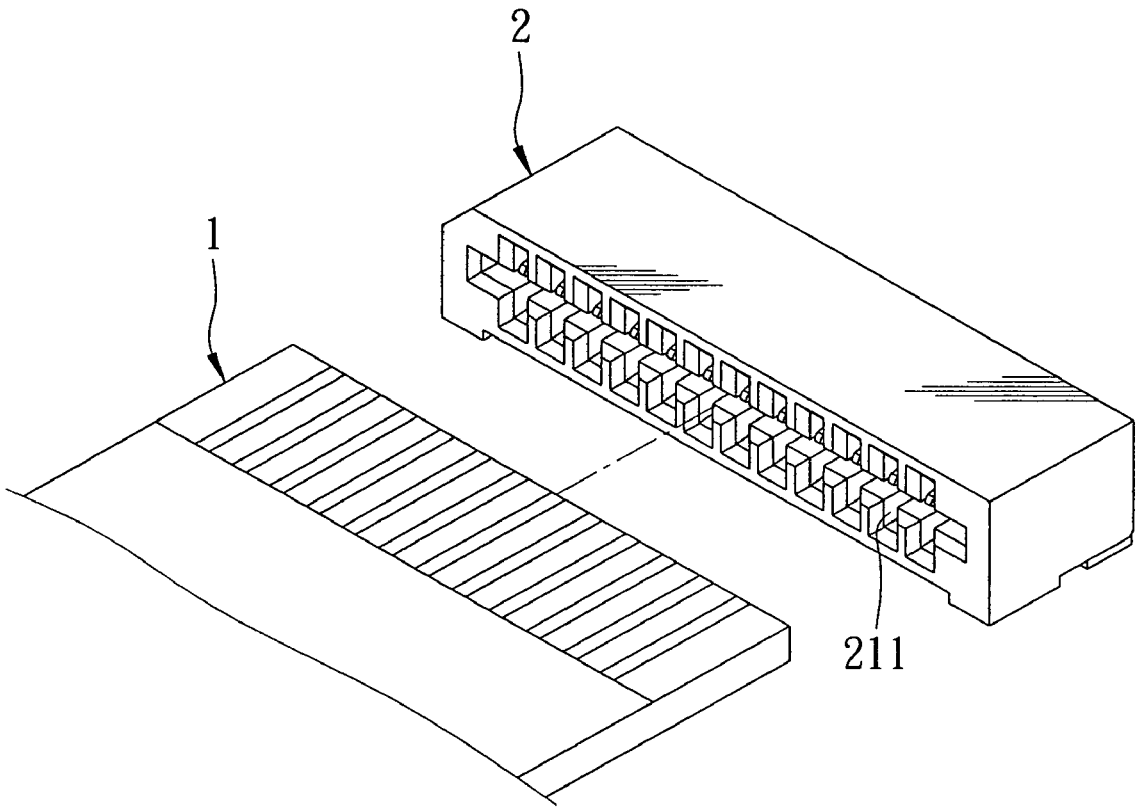
FIG. 1 PRIOR ART
FIG. 1 is a perspective view of a conventional electrical connector.
Figure 2:
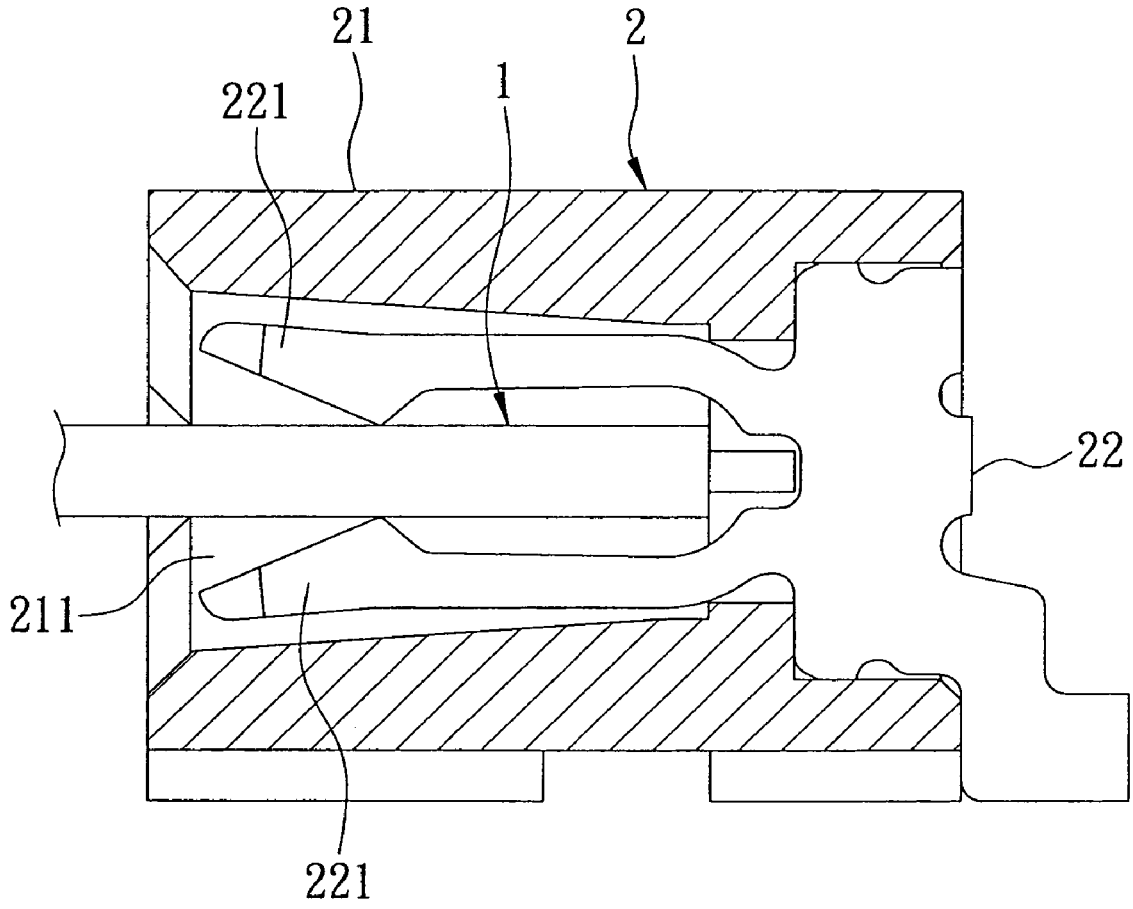
FIG. 2 PRIOR ART
FIG. 2 is a sectional view of the conventional electrical connector of FIG. 1 and a flexible printed circuit board.

Before the present invention is described in greater detail with reference to the accompanying preferred embodiments, it should be noted herein that like elements are denoted by the same reference numerals throughout the disclosure.

Figure 3:
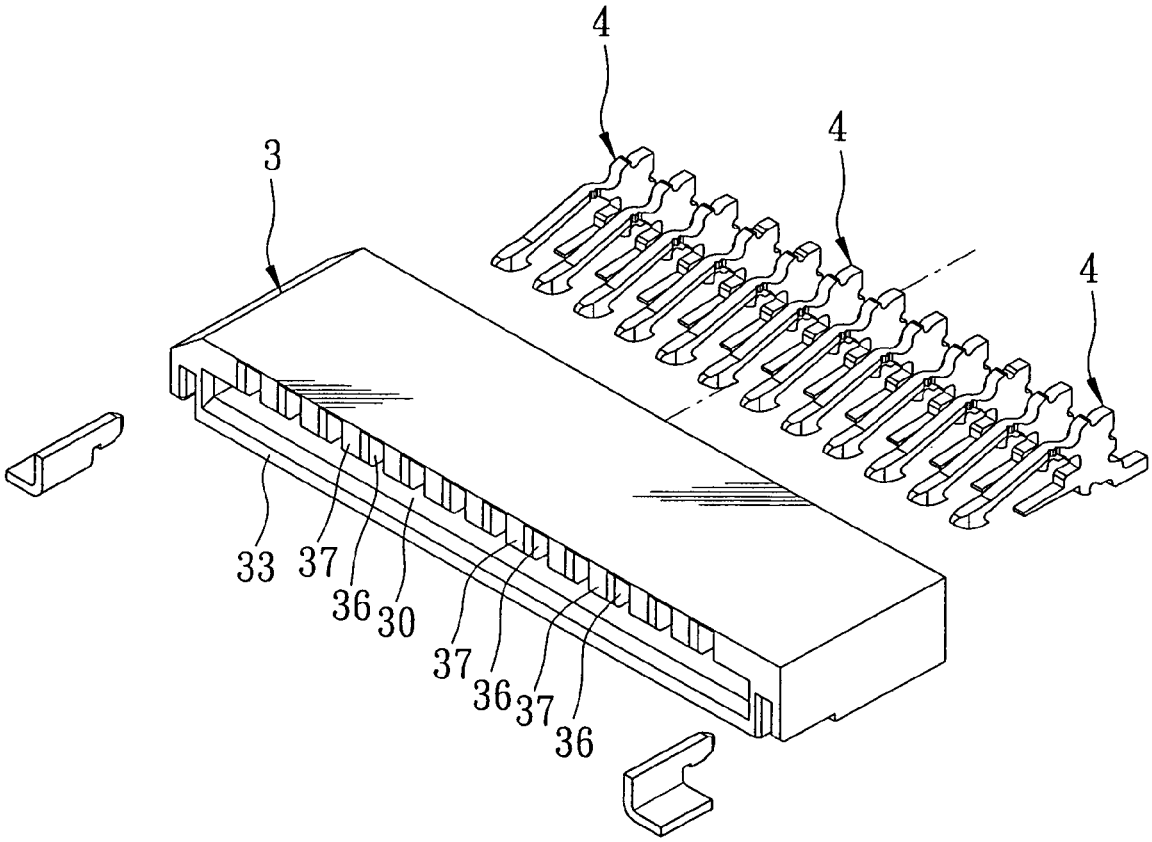
FIG. 3 is a perspective view of a first preferred embodiment of an electrical connector according to the present invention.
Figure 4:
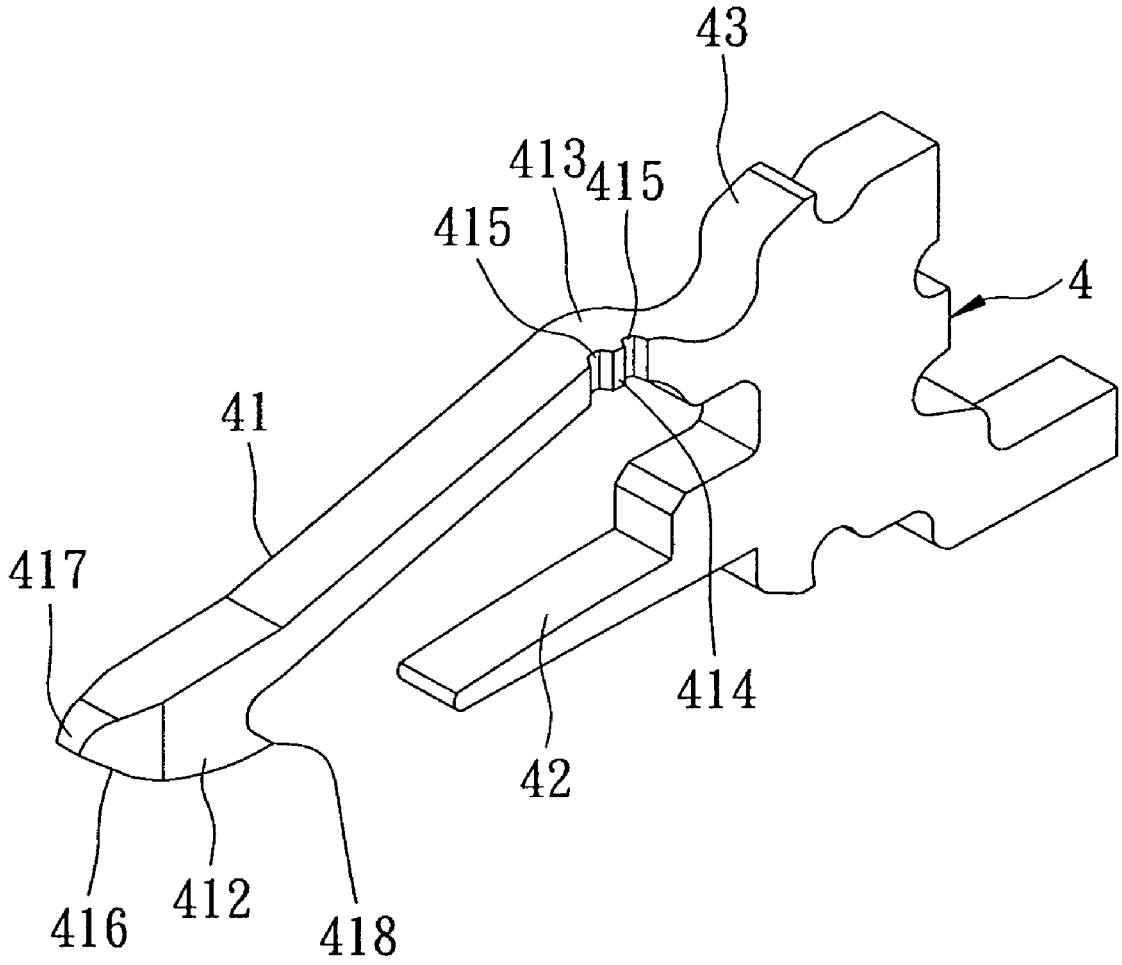
FIG. 4 is perspective view of a terminal of the electrical connector.
Figure 5:
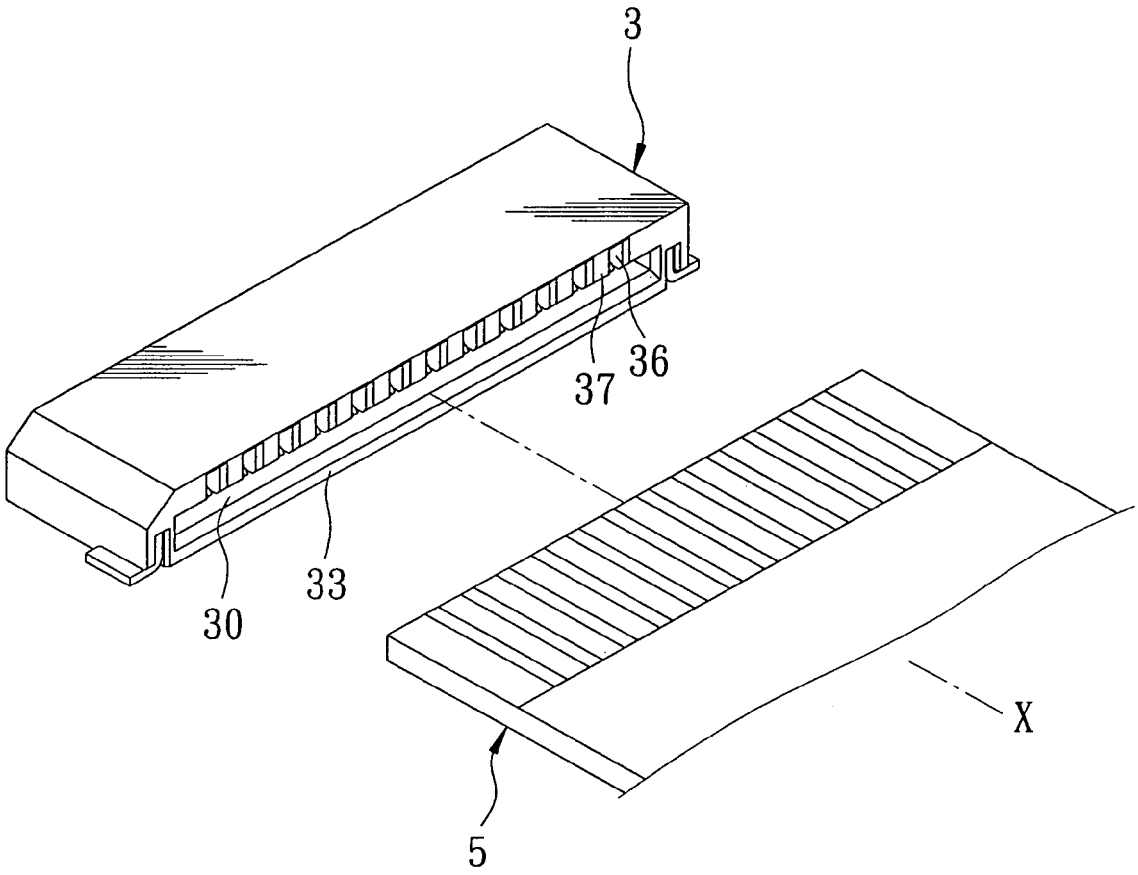
FIG. 5 is a perspective view illustrating a printed circuit board to be inserted into the electrical connector of the first preferred embodiment.

Referring to FIGS. 3 to 5, the first preferred embodiment of an electrical connector according to the present invention is shown to include a housing 3 and a plurality of terminals 4.

Figure 6:
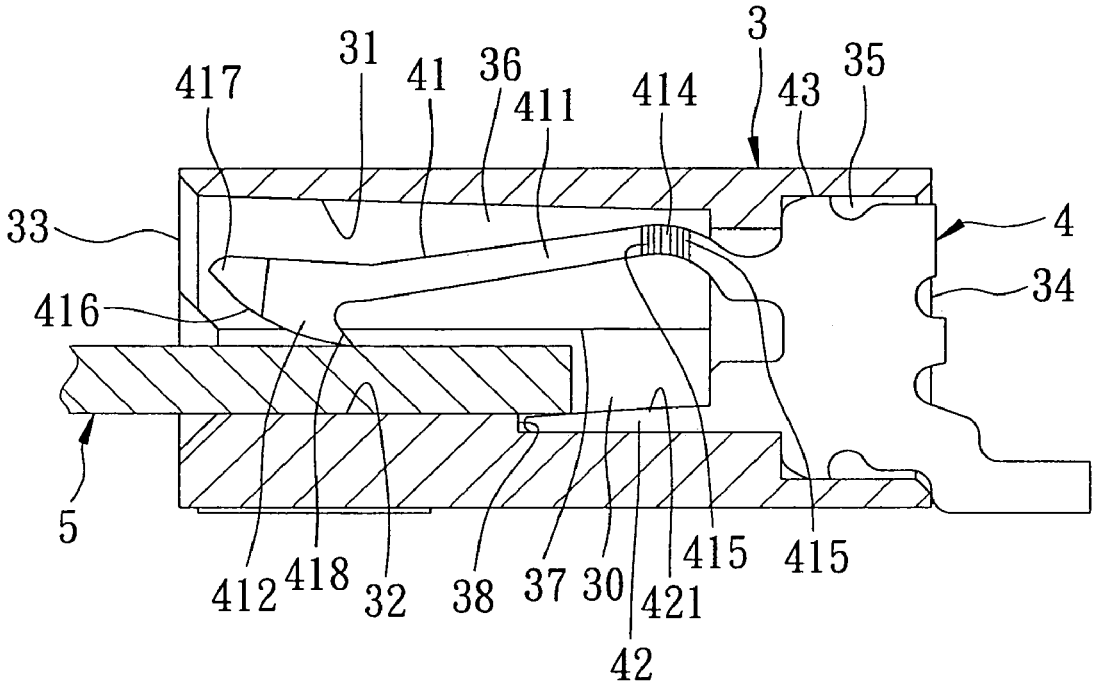
FIG. 6 is a sectional view illustrating that the printed circuit board has not been completely inserted into the electrical connector.

As best shown in FIG. 6, the housing 3 includes opposite front and rear end walls 33, 34, and upper and lower inner wall surfaces 31, 32 extending in a front-rear direction, an insertion slot 30 formed between the upper and lower inner wall surfaces 31, 32, and a fixing slot 35. The fixing slot 35 is proximate to the rear end wall 34. The insertion slot 30 opens at the front end wall 33. The upper inner wall surface 31 has a plurality of spaced apart ribs 37 that project therefrom to the insertion slot 30 and that confine therebetween a plurality of grooves 36 on an upper side of the insertion slot 30. The lower inner wall surface 32 has a plurality of recesses 38 that are formed on a lower side of the insertion slot 30 and that are aligned respectively with the grooves 36.

The terminals 4 are inserted into the insertion slot 30 through the fixing slot 35 of the housing 3. Each terminal 4 has a movable arm 41 and a stationary arm 42 that are disposed respectively on the upper and lower sides of the insertion slot 30 and that extend in a direction (X) from the rear end wall 34 to the front end wall 33. Particularly, the movable arms 41 of the terminals are respectively disposed inside the grooves 36, and the stationary arms 42 are fixed in the recesses 38, respectively. Each terminal 4 further has a base 43 fixed in the fixing slot 35. The base 43 has a leg 431 that may be soldered to a motherboard (not shown). The movable and stationary arms 41, 42 are connected to the base 43. The movable arm 41 has a front barb-like contact portion 412 proximate to the front end wall 33, and a connection portion 413 connected between the base 43 and the movable arm 41. The connection portion 413 has a reinforcing rib 414 formed between two depressions 415. The reinforcing rib 414 and depressions 415 are formed by press forming using a die, which increases the density of the material at the connection portion 413 and thereby strengthens the connection portion 413.

The front barb-like contact portion 412 has a frontmost end 417 proximate to the front end wall 33, a contact tip 418, and an inclined guide face 416 that extends rearwardly from the frontmost end 417 to the contact tip 418 and that is inclined gradually toward the insertion slot 30 from the frontmost end 417. The stationary arm 42 is tapered forwardly and has a front end distal from the front end wall 33, and an inclined contact face 421 that extends rearwardly from its front end thereof and that is inclined toward the insertion slot 30 from the front end thereof.

Figure 7:
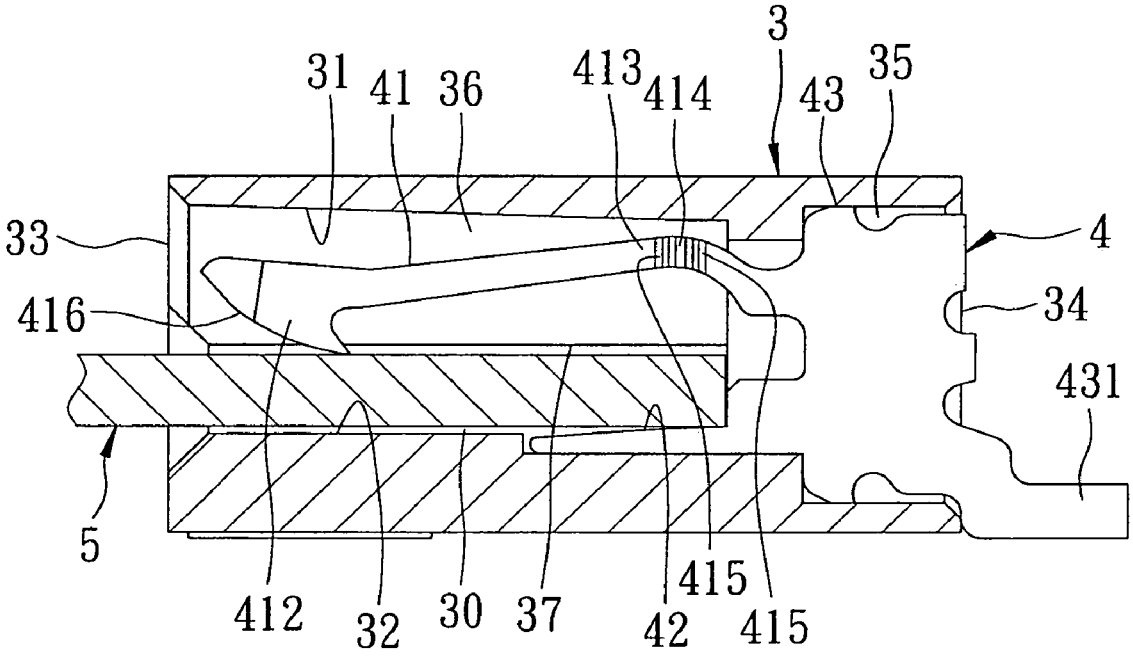
FIG. 7 is the same view as FIG. 6 but showing that the printed circuit board is fully inserted into the electrical connector.

Referring again to FIG. 6 and further to FIG. 7, when a printed circuit board 5 is inserted into the insertion slot 30 from the front end wall 33 and pushed inward, an upper surface of the printed circuit board 5 slides along the inclined guide face 416 and pushes the movable arm 41 upward. Because only the movable arm 41 applies a resisting force to the printed circuit board 5, the printed circuit board 5 can be inserted easily with a relatively low insertion force.

When the printed circuit board 5 is pushed further inward to extend beyond the contact tip 418 of the front barb-like contact portion 412, a lower surface of the printed circuit board 5 slides along the inclined contact face 421 of the stationary arm 42 that guides the printed circuit board 5 to move slightly upward. Accordingly, the printed circuit board 5 is clamped firmly between the contact tip 418 of the movable arm 41 and the inclined contact face 421 of the stationary arm 42. In addition, the contact tip 418 of the front barb-like contact portion 412 can efficiently prevent a releasing movement of the printed circuit board 5.

Figure 8:
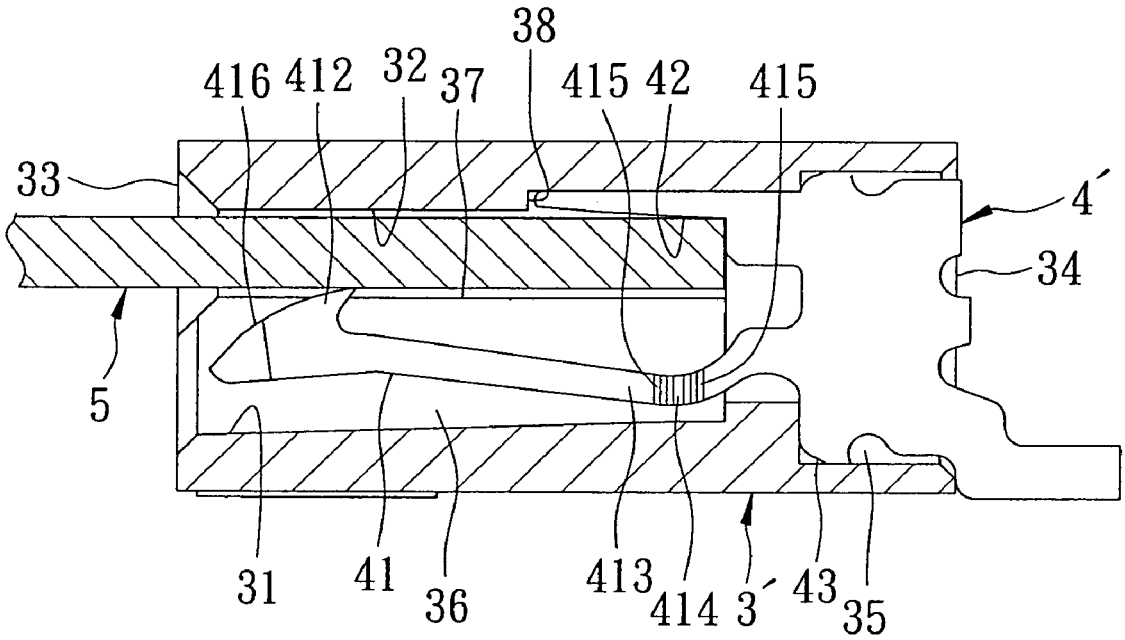
FIG. 8 is a sectional view of the second preferred embodiment of the present invention.

Referring to FIG. 8, the second preferred embodiment of the present invention is generally similar to the first preferred embodiment. However, each terminal 4' has the movable arm 41 disposed on the lower side of the insertion slot 30, and the stationary arm 42 disposed on the upper side of the insertion slot 30. The housing 3' has the grooves 36 disposed on the lower side of the insertion slot 30, and the recesses 38 are disposed on the upper side of the insertion slot 30. The aforesaid arrangement according to the second preferred embodiment permits the printed circuit board 5 to be inserted at a larger height compared to that offered by the first preferred embodiment.

The electrical connector of this invention has the following advantages:

1. Since this invention uses the single movable arm 41, the height of the housing 3 is reduced to 1.2 mm and 1.8 mm, which is about 60% of the height of the conventional electrical connector. Thus, the invention miniaturizes the construction of the electrical connector.

2. The use of the single movable arm 41 reduces the resistance against insertion of the flexible printed circuit board 5, thereby decreasing the insertion force for inserting the printed circuit board 5.

3) Referring to FIGS. 7 and 8, the electrical connector according to the present invention may be provided with two different configurations by interchanging the positions of the movable arm and stationary arm 41, 42 of each terminal 4 and by interchanging the positions of the grooves 36 and the recesses 38 in the housing 3. The height of the printed circuit board 5 to be installed on a motherboard (not shown) may be selected by choosing one of the two configurations.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electrical connector, comprising:

a housing including opposite front and rear end walls, opposite upper and lower inner wall surfaces extending in a front-rear direction, and an insertion slot that is formed between said upper and lower inner wall surfaces and that opens at said front end wall surface; and at least one terminal disposed in said housing and having a movable arm and a stationary arm, both of which extend in a direction from said rear end wall to said front end wall, said movable arm being disposed on one of upper and lower sides of said insertion slot, and having a front barb-like contact portion proximate to said front end wall, said stationary arm being disposed on the other one of said upper and lower sides of said insertion slot, and being tapered forwardly, said stationary arm having a front end distal from said front end wall, and an inclined contact face that extends rearwardly from said front end and that is inclined gradually toward said insertion slot from said front end.

2. The electrical connector of claim 1, wherein said housing further includes a fixing slot proximate to said rear end wall, said terminal further having a base fixed in said fixing slot, said movable and stationary arms being connected to said base.

3. The electrical connector of claim 2, which comprises a plurality of said terminals, one of said upper and lower inner wall surfaces having a plurality of spaced apart ribs that project to said insertion slot and that confine a plurality of grooves on one of said upper and lower sides of said insertion slot, the other one of said upper and lower inner wall surfaces having plurality of recesses that are formed on the other one of said upper and lower sides of said insertion slot and that are respectively aligned with said grooves, said stationary arms being fixed in said recesses, respectively, said movable arms being disposed in said grooves, respectively.

4. The electrical connector of claim 2, wherein said front barb-like contact portion has a frontmost end proximate to said front end wall, a contact tip, and an inclined guide face that extends rearwardly from said frontmost end to said contact tip and that is inclined toward said insertion slot from said frontmost end.

5. The electrical connector of claim 2, wherein said terminal further has a connection portion connected between said base and said movable arm, and having a reinforcing rib.

6. The electrical connector of claim 5, wherein said connection portion further has two depressions, said reinforcing rib being formed between said two depressions.

* * * * *